US005213074A

United States Patent [19]

Imagawa et al.

[11] Patent Number: 5,213,074

[45] Date of Patent: May 25, 1993

[54] LUBRICATING DEVICE OF FOUR-STROKE CYCLE ENGINE UNIT FOR PORTABLE WORKING MACHINE

[75] Inventors: Youichi Imagawa; Hiroshi Kohmoto, both of Tokyo, Japan

[73] Assignee: Ryobi Limited, Tokyo, Japan

[21] Appl. No.: 964,926

[22] Filed: Oct. 22, 1992

Related U.S. Application Data

[62] Division of Ser. No. 812,691, Dec. 23, 1991, Pat. No. 5,176,116.

[30] Foreign Application Priority Data

Dec. 26, 1990 [JP] Japan ..... 2-418425
Dec. 26, 1990 [JP] Japan ..... 2-418426

[51] Int. Cl.[5] ..... F01M 9/10

[52] U.S. Cl. ..... 123/196 M; 123/90.33; 123/90.23; 123/196 W

[58] Field of Search ..... 123/90.23, 90.33, 196 M, 123/196 W; 184/14.1

[56] References Cited

U.S. PATENT DOCUMENTS 1,806,770 5/1931 Van Weenen ..... 184/42
3,209,956 10/1965 McKenzie ..... 184/42
3,289,567 12/1966 Winter, Jr. ..... 123/90.33
3,410,366 11/1968 Winter, Jr. ..... 123/90.36
3,757,749 9/1973 Hatz ..... 123/90.23
4,113,061 9/1978 Peaster ..... 184/41
4,628,875 12/1986 Wells et al. ..... 123/90.33
4,662,323 5/1987 Moriya ..... 123/90.23
4,829,948 5/1989 Yoshida et al. ..... 123/90.33
5,027,762 7/1991 Tokuyama ..... 123/196 M
5,060,605 10/1991 Yamazaki ..... 123/90.23

FOREIGN PATENT DOCUMENTS 2159877 12/1985 United Kingdom ..... 123/90.23

*Primary Examiner*—E. Rollins Cross
*Assistant Examiner*—Erick Solis
*Attorney, Agent, or Firm*—Brooks & Kushman

[57] ABSTRACT

A four-stroke cycle engine unit for a working machine has generally a lubricating device for lubricating mechanical parts in a valve chamber and a cam chamber. The lubricating device comprises a body which has the cam chamber and a crank chamber, a cylinder head and a head cover having the valve chamber, and a mechanism for preventing a lubricating oil from escaping from at least one of through holes for push rods provided in a wall of the valve chamber and the cam chamber.

6 Claims, 15 Drawing Sheets

LUBRICATING DEVICE OF FOUR-STROKE CYCLE ENGINE UNIT FOR PORTABLE WORKING MACHINE

This is a divisional of copending application(s) Ser. No. 07/812,691 filed on Dec. 23, 1991, now U.S. Pat. No. 5,176,116.

BACKGROUND OF THE INVENTION

This invention relates to a four-stroke cycle engine unit to be incorporated in a portable working machine, and more particularly, to a lubricating device of a four-stroke cycle engine unit.

A portable working machine such as a lawn mower, a trimmer and a chain-saw is equipped with an internal combustion engine unit. In such a portable working machine, it is required for the engine unit to have a relatively compact structure and light weight because such a working machine is operated by hands of an operator and also required to be revolved with high rotation speed. It would also be better to be manufactured with a cheap cost. Such requirements may be satisfied by incorporating a two-stroke cycle engine in the machine.

In comparison of such a two-stroke cycle engine unit with a four-stroke cycle engine unit, the latter engine unit generates noise lower than that of the former engine unit and generates relatively clean exhaust gas, and the latter engine unit is operated with a reduced fuel consumption. In these points, the latter engine unit may be superior to the former engine unit.

However, the common portable working machine is often used in an inclined or an inverted posture.

The engine unit is lubricated in a way that a mist of a lubricating oil in a crank chamber is fed into a valve chamber having an exhaust valve and an intake valve, and a cam chamber accommodating a cam for driving the exhaust and intake valves.

However, when the engine unit is driven in an inclined or inverted posture, the condition of the oil mist is changed, so that it is difficult to control the lubricating of the engine unit.

SUMMARY OF THE INVENTION

An object of this invention is to provide a lubricating device of a four-stroke cycle engine unit for a portable working machine capable of lubricating inside of the valve chamber without using a lubricating oil of the crank chamber.

According to the present invention, there is provided a lubricating device of four-stroke cycle engine unit for a portable working machine, said lubricating device comprising: a body having a cam chamber which accommodates a crank gear mounted on a crank shaft, a cam gear meshed with the crank gear and a cam mounted on the cam gear, said body having a crank chamber accommodating a crank mechanism and sealing a lubricating oil; a cylinder head portions having a valve chamber accommodating rocker arms which are swingable by push rods moving upward and downward through rotation of the cam and which move an exhaust valve and an intake valve in said valve chamber sealing a lubricating oil; and a mechanism for preventing escape of the lubricating oil from at least one of through holes for push rods, provided in a wall of the valve chamber and the cam chamber.

BRIEF DESCRIPTION OF THE DRAWINGS

For a better understanding of this invention and to show how the same is carried out, reference is first made, by way of preferred embodiments, to the accompanying drawings, in which:

FIGS. 1 to 10 represent a first embodiment according to this invention, in which:

FIG. 1 is an illustration of a lawn mower as one kind of a portable working machine, to which an engine unit of this invention is applicable, when used by an operator;

FIG. 2 is an elevational section of the engine unit of the lawn mower of FIG. 1;

FIG. 3 is a front view of a valve drive mechanism of the engine unit, taken along the line III—III of FIG. 2;

FIG. 4 is a plan view of a lifter assembly of FIG. 3;

FIG. 5 is a sectional view, partially cut away, of the engine unit in an inverted posture;

FIG. 6 is a sectional view, partially cut away, of an engine unit in a normal posture and showing a modification thereof;

FIG. 7 is a sectional view, partially cut away, of the engine unit, shown in FIG. 6, in an inverted posture;

FIG. 8 is a sectional view, partially cut away, of an engine unit in a normal posture and showing another modification thereof; and FIGS. 9 and 10 are sectional views of still another modifications of the engine unit, partially broken away, according to this embodiment, in a normal posture.

FIGS. 11 to 14 are views representing a second embodiment of an engine unit according to this invention, in which;

FIG. 11 is an elevational section of the engine unit;

FIG. 12 is a front view of a cam drive mechanism of the engine unit shown in FIG. 11;

FIG. 13 is a sectional view taken along the line XIII—XIII of FIG. 12; and FIG. 14 is a sectional view, partially cut away, of the engine unit, shown in FIG. 11, in an inverted posture.

FIGS. 15 to 17 are views representing a third embodiment of an engine unit according to this invention, in which;

FIG. 15 is a sectional view of the engine unit having a lubricating mechanism of this embodiment;

FIG. 16 is a sectional view, partially cut away, of a valve chamber of a cylinder head; and FIG. 17 is a sectional view taken along the line XVII— XVII of FIG. 16;

FIGS. 18 and 19 represent prior art, in which:

FIG. 18 is an elevational section of a conventional engine unit for a portable working machine; and FIG. 19 is a front view of a portion of the conventional engine unit shown in FIG. 18.

DESCRIPTION OF THE PREFERRED EMBODIMENTS

First, for a better understanding of this invention, a conventional art will be described hereunder with reference to FIGS. 18 and 19.

Figure 18:
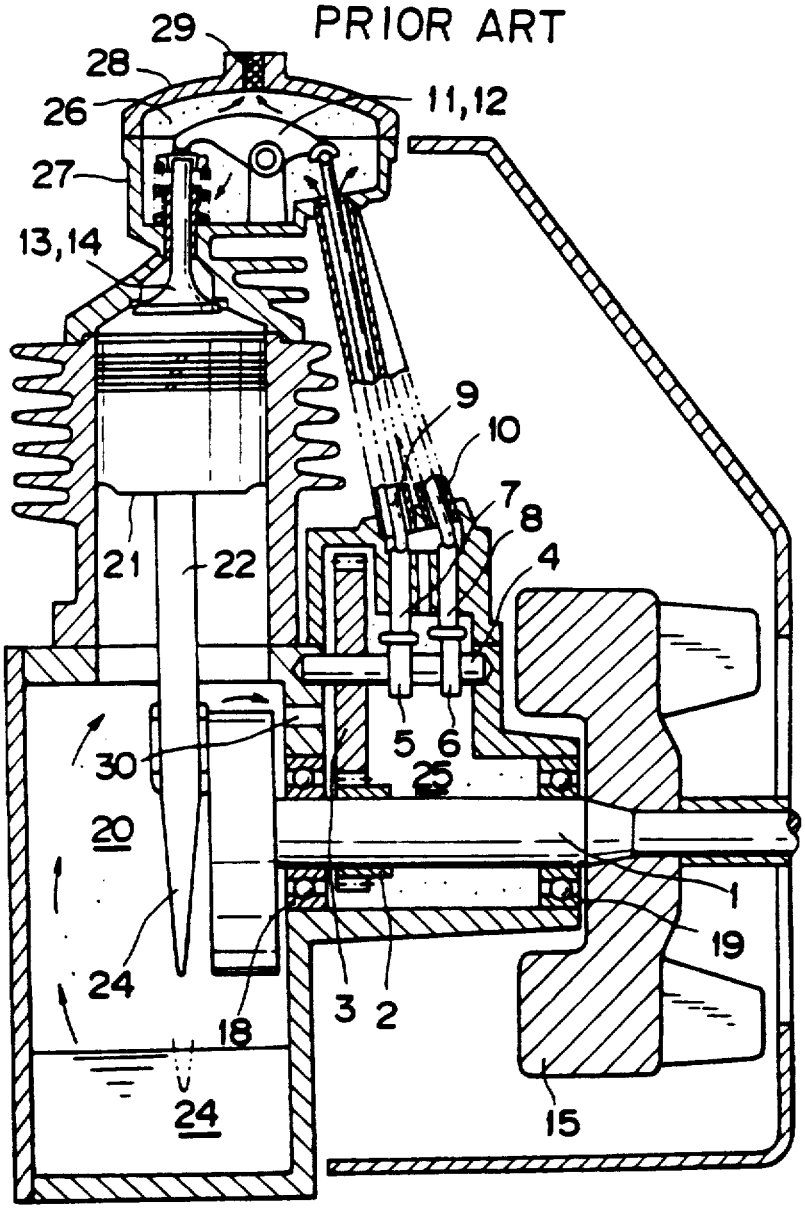
FIG. 18 PRIOR ART
Figure 19:
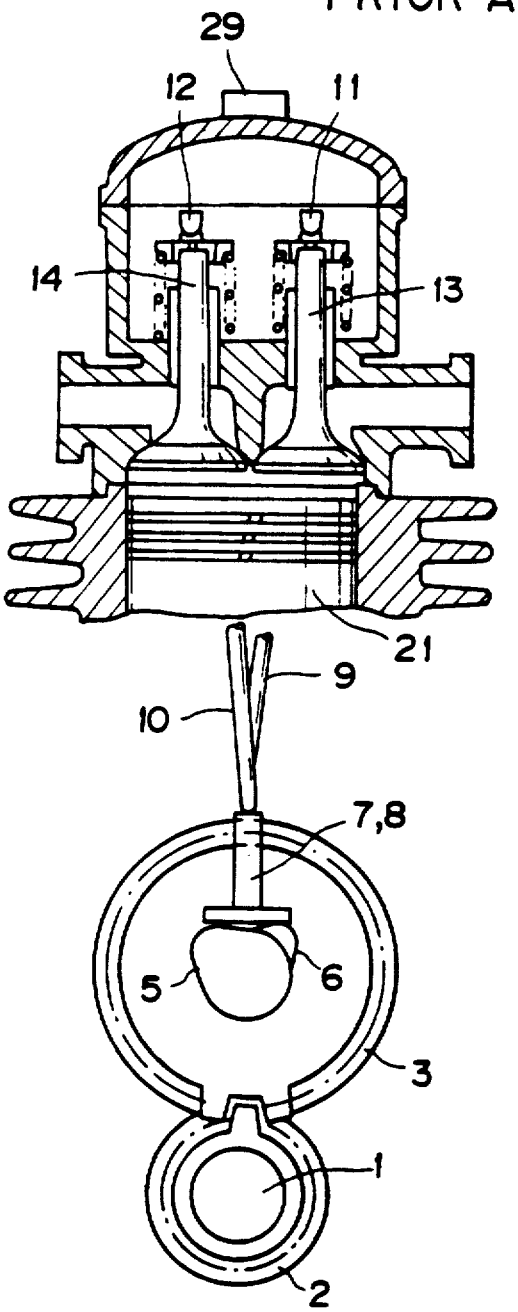
FIG. 19 PRIOR ART

In a conventional four-stroke cycle engine unit, as shown in FIGS. 18 and 19, an engine unit includes a crank shaft 1, which is rotatably supported by bearings 18 and 19, onto which a crank gear 2 is mounted. When the crank gear 2 is rotated, a cam gear 3 mounted on a cam shaft 4 and meshed with the crank gear 2 is also rotated in a direction reverse to the rotation of the crank gear 2. Onto the cam shaft 4 are mounted an air inlet cam 5 and an exhaust cam 6, and an air intake valve 13 and an air exhaust valve 14 are operated in accordance with the rotations of these cams 5 and 6 through tappets 7, 8, push rods 9, 10 and rocker arms 11, 12, respectively, in this order. A fly wheel 15 is mounted on one end of the crank shaft 1 to transmit a power to a power driving system through a clutch, not shown.

For lubricating mechanical parts in a crank chamber 20, a paddling rod which is fixed to one end of a connecting rod 22 connected with a piston 21 paddles upward liquid lubricating oil 24 in the crank chamber 20 according to the rotation of a crank shaft 1.

For lubricating mechanical parts in a cam chamber 25 and valve chamber 26, a cylinder head 27 is provided with a breather 29, and the lubricating oil 24 in the crank chamber 20 enters into the cam chamber 25 and the valve chamber 26 through a bearing 18 and a through hole 30 and exhausts from the breather 29 outside of the engine unit as an oil mist, so that parts of the engine unit are lubricated.

However, in the conventional technology, as shown in FIGS. 18 and 19, it is difficult to control the lubricating condition of the cam chamber 25 and valve chamber 26.

This invention conceived for solving the above problems encountered in the prior art will be described hereunder with reference to the preferred embodiments.

First Embodiment

Figure 1:
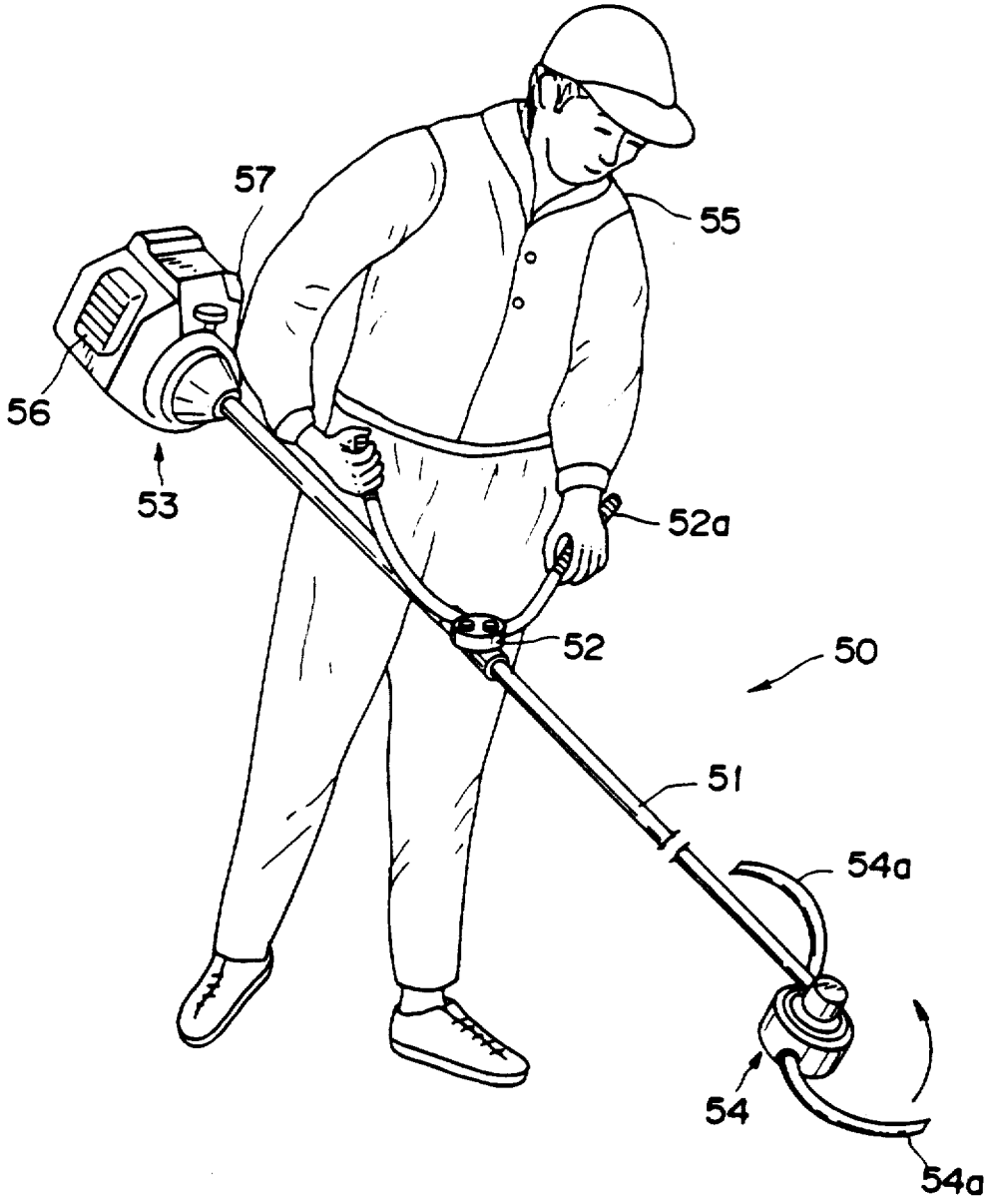

A first embodiment is described with reference to FIGS. 1 to 10, which is applied to a portable working machine such as a lawn mower 50 such as shown in FIG. 1.

The lawn mower 50 shown in FIG. 1 generally comprises a long shaft-like power transmission member 51, an operating portion 52 on which a handle 52*a* is provided, an engine unit 53 secured to one end of the transmission shaft member 51 and a working device 54 secured to the other end thereof. The power generated by the driving of the engine unit 53 is transmitted to the working device 54 including a working portion such as a lawn mower blade 54*a* through the power transmission shaft member 51. The shaft member 51 is composed of an outer pipe and an inner steel wire or rod which is connected to the crank shaft, i.e. output shaft, of the engine unit 53 through a clutch means. The steel rod is rotatably supported in the outer pipe and transmits the power to the working device 54 and, hence, the lawn mower blade 54*a*.

When the working machine 50 is actually used, the working machine 50 is supported by an operator 55 who generally stands on the right side of the engine unit 53 as viewed in FIG. 1 and holds or grips the handle 52*a*. In consideration of such general attitude of the working condition, an exhaust gas muffler 56 for preventing the operator from being suffered from the spitting of the heated exhaust gas is provided on the engine unit 53 on the side apart from the operator 55, and an air intake port 57 of a carburetor is formed on the side near the operator 55.

Figure 2:
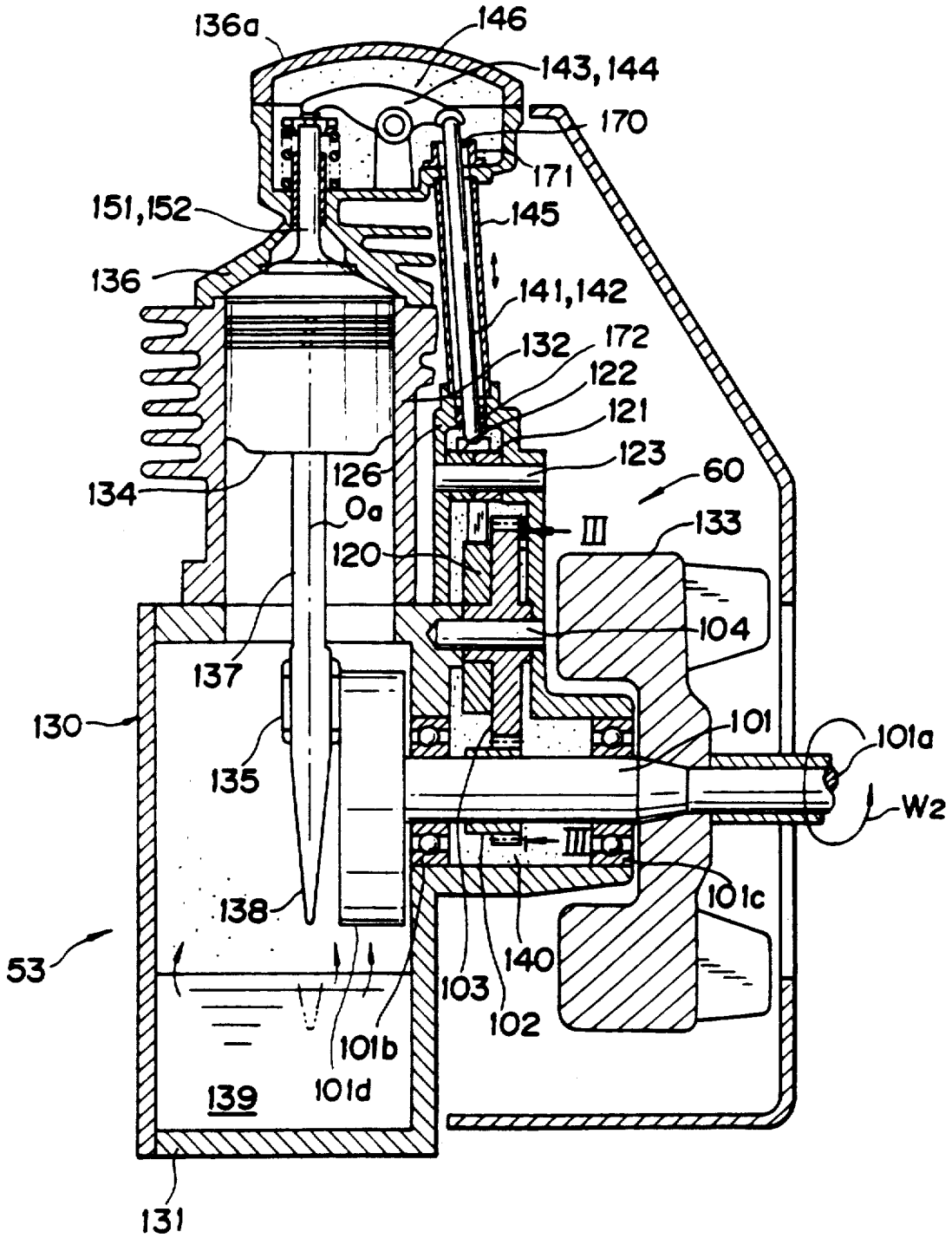
Figure 3:
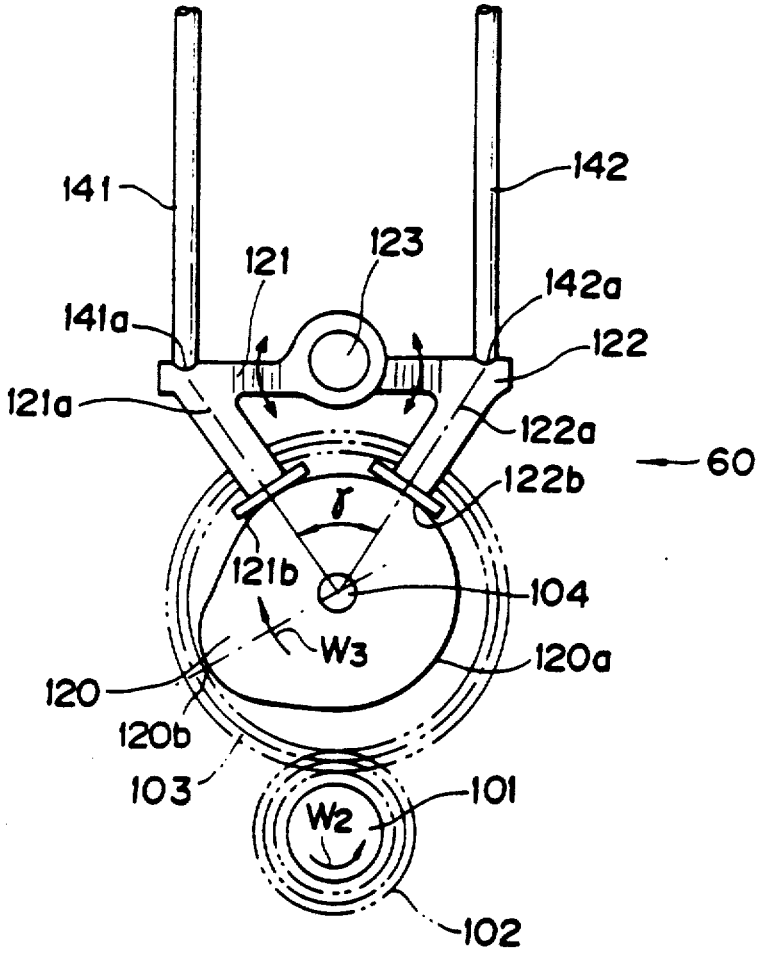
Figure 4:
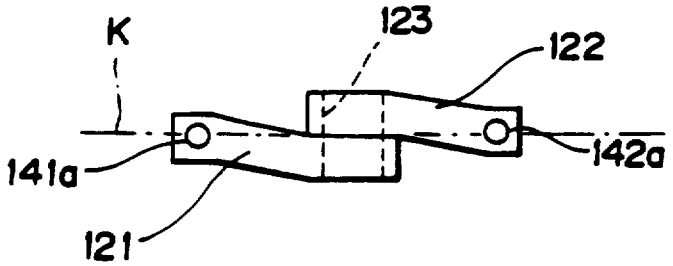

As shown in FIGS. 2 to 4, the portable type engine unit 53 for the working machine 50 is equipped with a lubricating device. A main body 131 and a crank case 130 of the engine unit 53 constitutes a crank chamber 130*a*. The engine unit 53 includes a crank shaft 101 having one end on which is integrally formed a power output shaft 101*a* which is connected to the power transmission shaft 51. On the outer periphery of the crank shaft 101 is mounted a crank shaft gear 102 which is meshed with a cam gear 103, and accordingly, when the crank shaft gear 102 is rotated, the cam gear 103 is followed and rotated in a direction reverse to the rotation of the crank gear 102.

The cam gear 103 is rotatably mounted on a cam shaft 104 fixedly supported to the main body 131 of the engine unit 53, and a cam 120 is secured to the cam gear 103. As shown in FIG. 3, a lifter assembly comprising a pair of rockable or swingable lifters 121 and 122 is disposed so as to abut against the cam 120 at their one ends, and the lifters 121 and 122 are swingable about a common lifter axis 123 such as a pin through which these two lifters 121 and 122 are operatively coupled. The lifter axis 123 and the cam shaft 104 are positioned in a plane, that is, on the drawing sheet surface of FIG. 2, including a crank shaft 101 and a cylinder center line 0*a*. The lifter axis 123, the cam shaft 104 and the crank shaft 101 are arranged in parallel to each other.

The left lifter 121 is connected to a push rod 141, accommodated in a cover tube 145, for the exhaust valve and the right lifter 122 is connected to a push rod 142, accommodated in another cover tube 145, for the intake valve, the push rods 141 and 142 being moved in a reciprocal manner. These lifters 121 and 122 are formed of the same material and disposed so as to face with each other, and as shown in FIG. 4 from the upper side, these lifters 121 and 122 are bent to the same extent such that the lefthand end of the lifter 121 is bent upwardly as viewed in FIG. 4 and the righthand end of the lifter 122 is bent downwardly also as viewed in FIG. 4. Accordingly, a contact point 141*a* formed at the lefthand end of the lifter 121 contacting the push rod 141 and a contact point 142*a* formed at the righthand end of the lifter 122 contacting the push rod 142 lie on the same plane K extending perpendicularly to the lifter axis 123. Further, the center axes 121*a* and 122*a* of arms of these lifters 121 and 122 cross at the center point of the cam shaft 104 at an angle of $\gamma$ when the lifters abut against the cam circumferential portion 120*a* of the cam 120. The lifters 121 and 122 have free ends formed as flat platelike portions 121*b* and 122*b* which contact the cam circumferential portions 120*a* of the cam 120 and the contact points 141*a* and 142*a* of the push rods 141 and 142 are positioned symmetrically with respect to the lifter axis 123 as shown in FIG. 3.

As described above, the exhaust valve 151 and the intake valve 152 shown in FIG. 2 are operated by the cam 120 through a pair of lifters 121 and 122 and the corresponding push rods 141 and 142. The valve drive mechanism 60 thus constructed by the lifters 121, 122, the cam gear 103 and the cam 120 is accommodated in a lifter supporting body 126 fastened, by means of bolts, for example, to the main body 131.

The reciprocal push rods 141 and 142 for the exhaust valve 151 and the intake valve 152 are respectively coupled to a pair of rocker arms 143 and 144 swingably provided in a valve chamber 146 which is formed at an upper portion of a cylinder head 136 of the engine unit 53 and covered by a head cover 136*a*. These rocker arms 143 and 144 are also respectively connected to the exhaust valve 151 and the intake valve 152 disposed to the cylinder head 136 positioned at the upper portion of the cylinder assembly 132 of the engine main body 131, thereby these valves 151 and 152 being operated to be opened or closed in accordance with the rocking motions of the rocker arms 143 and 144. Each of push rods 141 and 142 is covered with each of push rod covers 145 fixed to the lifter supporting body 126 and the cylinder head 136 of the valve chamber 146.

The crank shaft 101 is supported to be rotatable by the bearings 101*b* and 101*c* and has a portion, on the side of the output shaft 101*a*, onto which a fly wheel 133 is mounted so that an engine power as a rotational force is transmitted from the output shaft 101*a* to the power transmission shaft 51 as the rotational force through a clutch, not shown.

Accordingly, when the crank shaft 101 is rotated, by the movement of the piston 134 reciprocally displaced in the cylinder 132, in a counterclockwise direction $W_2$ (when the engine unit 53 is viewed from the output shaft side), the cam gear 103 meshed with the crank gear 102 is rotated in a clockwise direction $W_3$ as shown in FIG. 3. A connecting rod 137 connected to the piston 134 is connected to a counter weight 101*d* fixed to an end of the crank shaft 101 by a pin 135. According to the rotation of the cam gear 103, the cam 102 secured to the cam gear 103 is also rotated in the clockwise direction $W_3$. In response to this rotation, one lifter 121 of the paired lifters is first rocked in the clockwise direction and the push rod 141 for the exhaust valve 151 is moved upwardly as viewed to thereby open the exhaust valve 151 through the motion of the rocker arm 143. Then the cam 120 is further rotated, and after the flat portion 121*b* of the lifter 121 moves over the protruded portion 120*b* of the cam 120, the lifter 121 is rocked counterclockwisely to close the exhaust valve 151 through the motions of the push rod 141 and the rocker arm 143. Just before the closing of the exhaust valve 151, the intake valve 152 is operated to be opened. Namely, during the further rotation of the cam 120, the other lifter 122 contacting the cam surface of the cam 120 is rocked in the counterclockwise direction and the push rod 142 for the intake valve 152 is moved upwardly to thereby open the intake valve 152 through the motion of the rocker arm 144. The exhaust valve 151 is then closed. Next, when the cam 120 is still further rotated, the lifter 122 is clockwisely rocked and the intake valve 152 is operated to be closed through the motions of the push rod 142 and the rocker arm 144. When the intake valve 152 has been closed, one operation cycle of the exhaust and intake valves 151 and 152 has been completed.

A liquid lubricating oil 139 is sealed in the crank chamber 130*a* which accommodates a crank mechanism. For lubricating the crank mechanism in the crank chamber 130*a*, the paddling rod 138 fixed to one end of the connecting rod 137 paddles upwardly the liquid lubricating oil 139. A lubricating oil such as grease including molybdenum is sealed in a cam chamber 140 accommodating a cam mechanism and in the valve chamber 146 accommodating a rocking mechanism such as the rocker arms 143 and 144, respectively.

Cylindrical parts 171 as means for preventing escaping of oil are fixed to one ends of through holes 170 of the valve chamber 146 so as to project into the valve chamber 146. An inside diameter of each of the cylindrical parts 171 is approximately equal to an inside diameter of each of the through holes 170. Each cylindrical part 171 prevents the oil in the valve chamber 146 from escaping to the cam chamber 140 through each through hole 170 when the engine unit 53 is in a normal posture.

A guide portion or seal 172 as means for preventing escaping of oil is provided in each through hole formed in the lifter supporting body 126 of the main body 131. The push rods 141 and 142 can smoothly slide in each seal 172. Each seal 172 is preferably made of elastic rubber. As described above, the engine unit 53 is sometimes used in an inclined posture (for example, inclined at an angle 70° from the normal posture) or an inverted posture (for example, inclined at an angle 180° from the normal posture).

Figure 5:
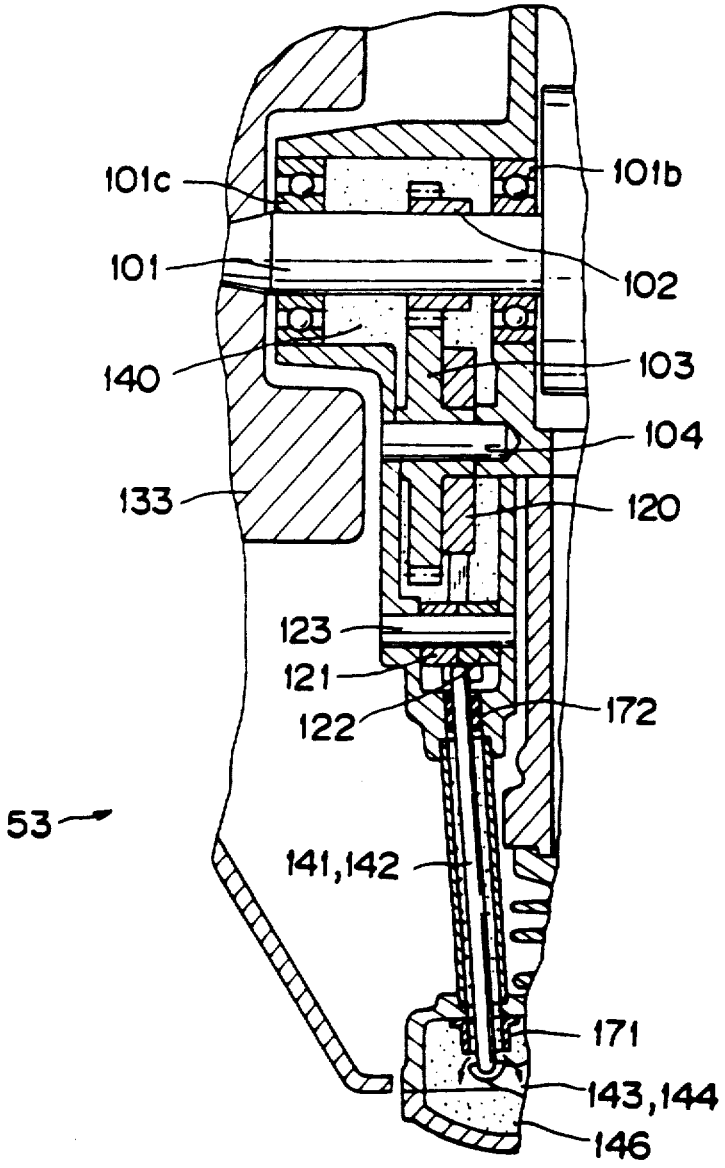

Since the engine unit 53 has the seal 172, even when the engine unit 53 is inverted as shown in FIG. 5, the lubricating oil in the cam chamber 140 does not flow out to the valve chamber 146 through the cover tubes 145. When the engine unit 53 is in the normal posture as shown in FIG. 2 the cylindrical parts 171 prevent the lubricating oil from escaping from the valve chamber 146 into the cover tubes 145. When the engine unit 53 is in the inclined posture, the lubricating oil in the valve chamber 146 sometimes goes over the cylindrical parts 171 to enter into the cover tubes 145. However, since the seals 172 is provided, the oil does not enter into the cam chamber 140. Accordingly, the oil of the valve chamber 146 never mixes with the oil of the cam chamber 140.

Figure 6:
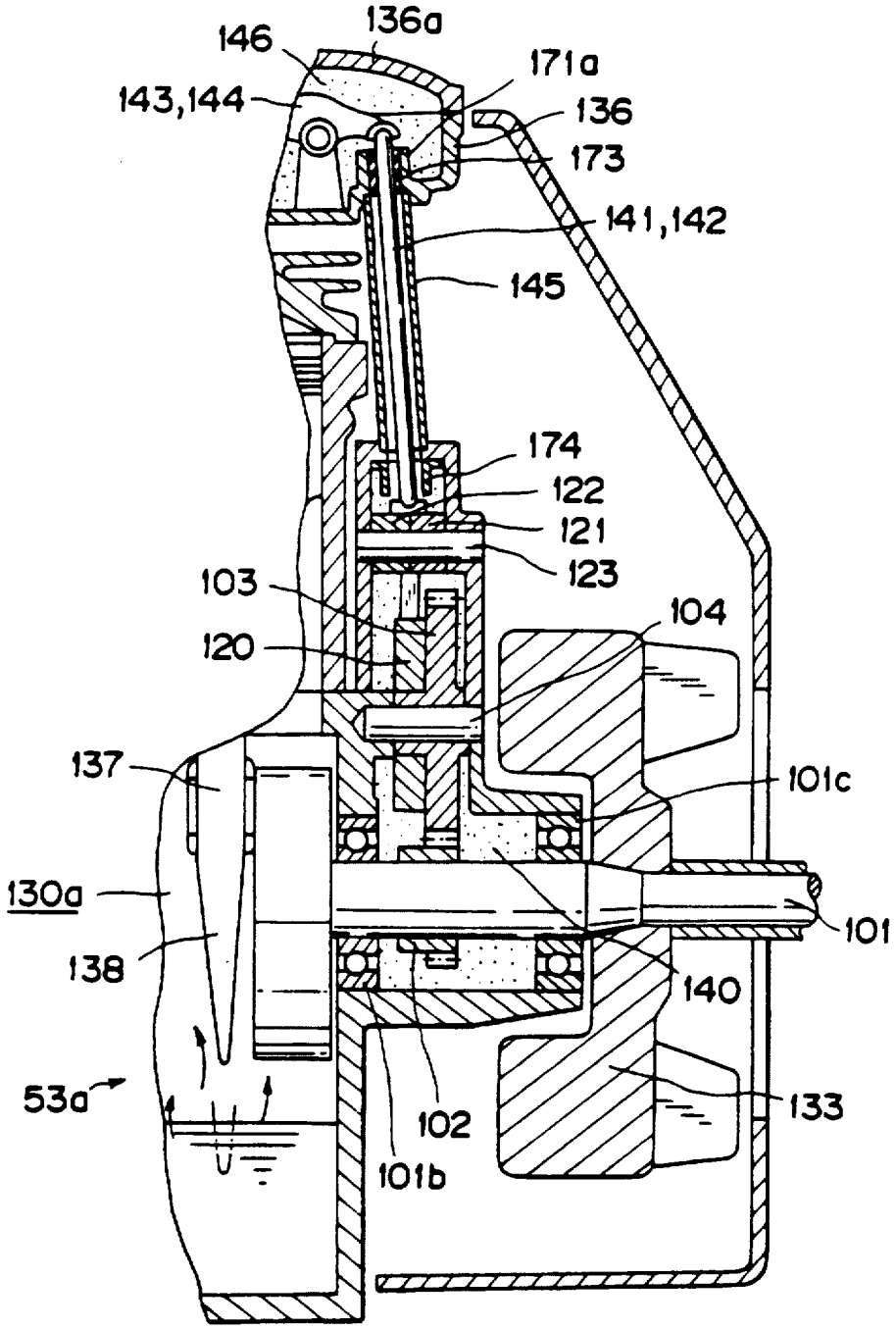
Figure 7:
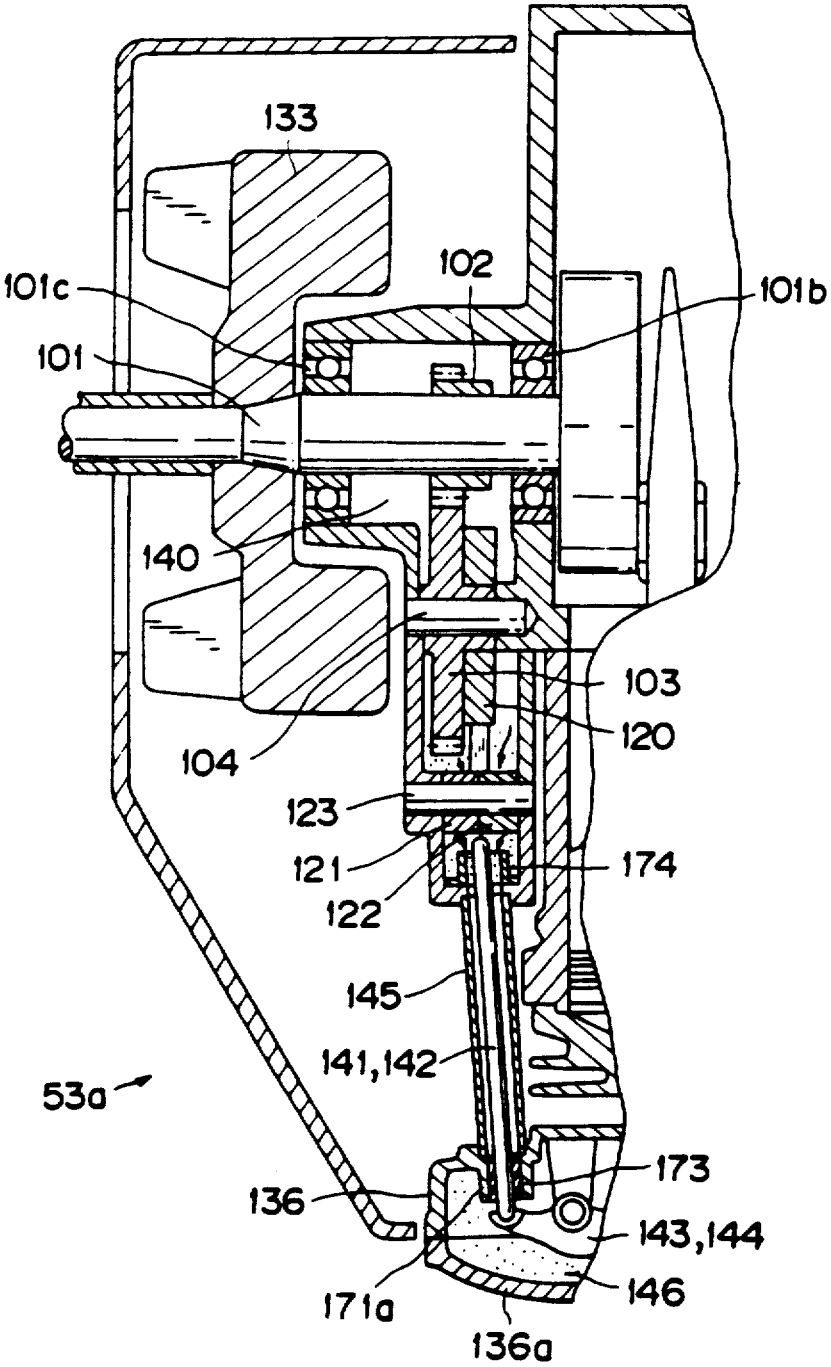

FIGS. 6 and 7 show an engine unit 53*a* of a modification of this embodiment. As shown in these Figures, means for preventing escaping of oil comprises two cylindrical parts 171*a* integrally formed on a wall of the cylinder head 136 so as to project in the valve chamber 146, and two seals 173 respectively provided in the cylindrical parts 171*a*. The push rods 141 and 142 slide smoothly in the seals 173 made of rubber, respectively. Cylindrical parts 174 are provided at the inner ends of the through holes of the push rods 141 and 142 so as to project into the cam chamber 140 from the inner wall of the lifter supporting body 126.

In this embodiment, the lubricating oil of the valve chamber 146 is sealed by the cylindrical parts 171*a* and the seals 173, so that when the engine unit 53*a* is in the normal posture as shown in FIG. 6, the lubricating oil of the valve chamber 146 does not move into the cam chamber 140. When the engine unit 53*a* is inverted as shown in FIG. 7, the lubricating oil of the cam chamber 140 goes over the cylindrical parts 174 to enter into the cover tubes 145. However, since the seals 173 are provided, the oil does not enter into the valve chamber 146.

Figure 8:
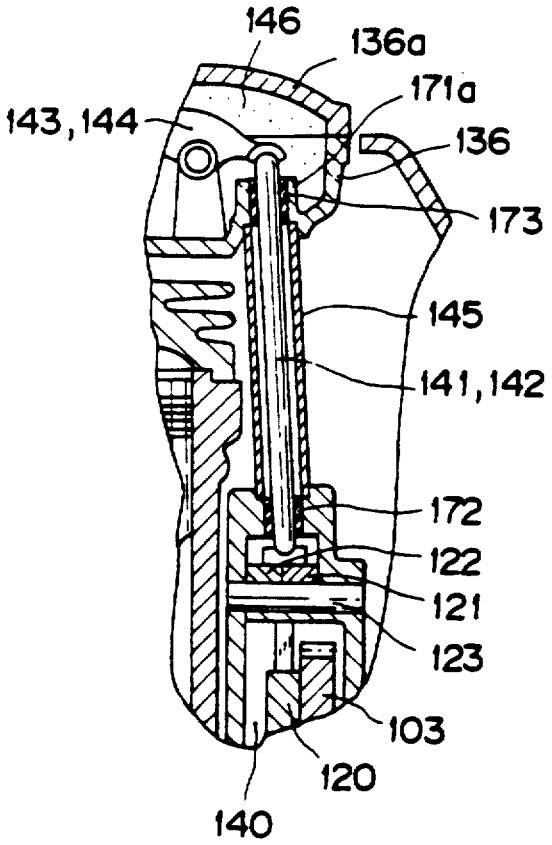

FIG. 8 shows another modification of the engine unit shown in FIG. 6. In this embodiment, the seals 172 are provided in the through holes of the push rods 141 and 142 on the wall of the cam chamber 140 in the same manner as the embodiment in FIG. 6. Further, the seals 173 are provided in the respective cylindrical parts 171*a* on the valve chamber 146 in the same manner as the embodiment in FIG. 6. Accordingly, both oils in the valve and cam chambers 146 and 140 do not enter into the cover tubes 145.

Figure 9:
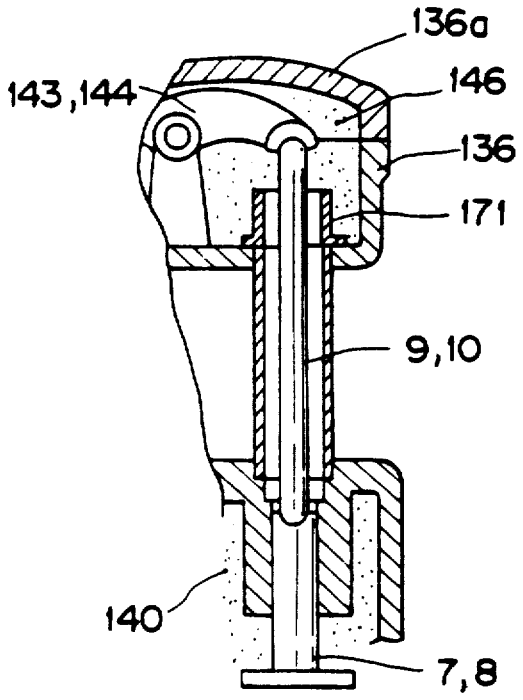
Figure 10:
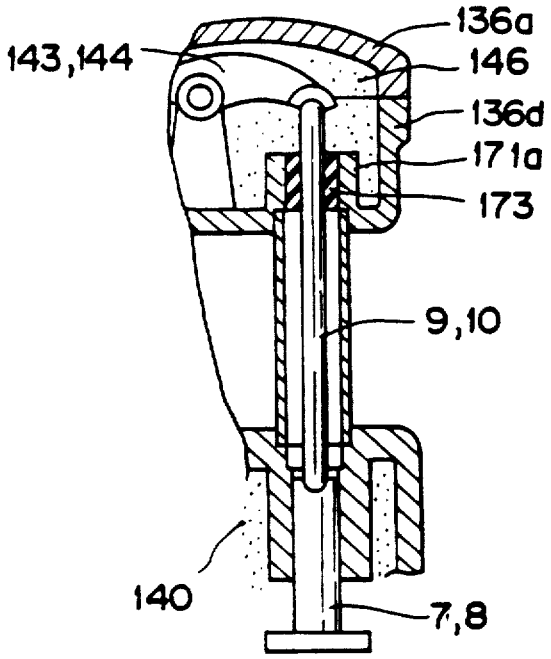

FIGS. 9 and 10 show still another modifications of the engine unit. In these embodiments, two push rods 9 and 10 reciprocated by two tappets 7 and 8, respectively, and two rocker arms 143 and 144 are swung by the push rods 9 and 10. As shown in FIG. 9, the cylindrical parts 171 as means for preventing escaping of oil are fixed to the inner ends of the through holes of the valve chamber 146 to project into the valve chamber 146.

In a structure shown in FIG. 10, seals 173 are fixedly inserted into the cylindrical parts 171. The cam smoothly move in the seals 173 made of rubber.

As described above, according to the lubricating device of the engine unit in the first embodiment, the lubricating oil 139 sealed in the crank chamber 130*a* is not used for lubricating the valve chamber 146. That is, lubricating oils are sealed in the valve chamber 146 and the cam chamber 140, respectively, and lubricating operation for each chamber is effected independently by each oil sealed in each chamber. Accordingly, the lubricating efficiency of this embodiments is increased in comparison with a traditional engine unit. In this embodiment, at the opposite ends of the push rods 141 and 142 is provided a plurality of means for preventing the oil escape. Therefore, the lubricating oil sealed in the valve chamber 146 and the cam chamber 140 cannot escape to other portions in the engine unit is at all situations such as normal, inverted or inclined ones. Further, it is not necessary to newly supply the lubricating oil into the valve chamber 146 and cam chamber 140 or exchange the oil therein for new oil for a long time, so that a life span of the oil 139 in the crank chamber 130a can be remarkably prolonged.

Second Embodiment

Figure 11:
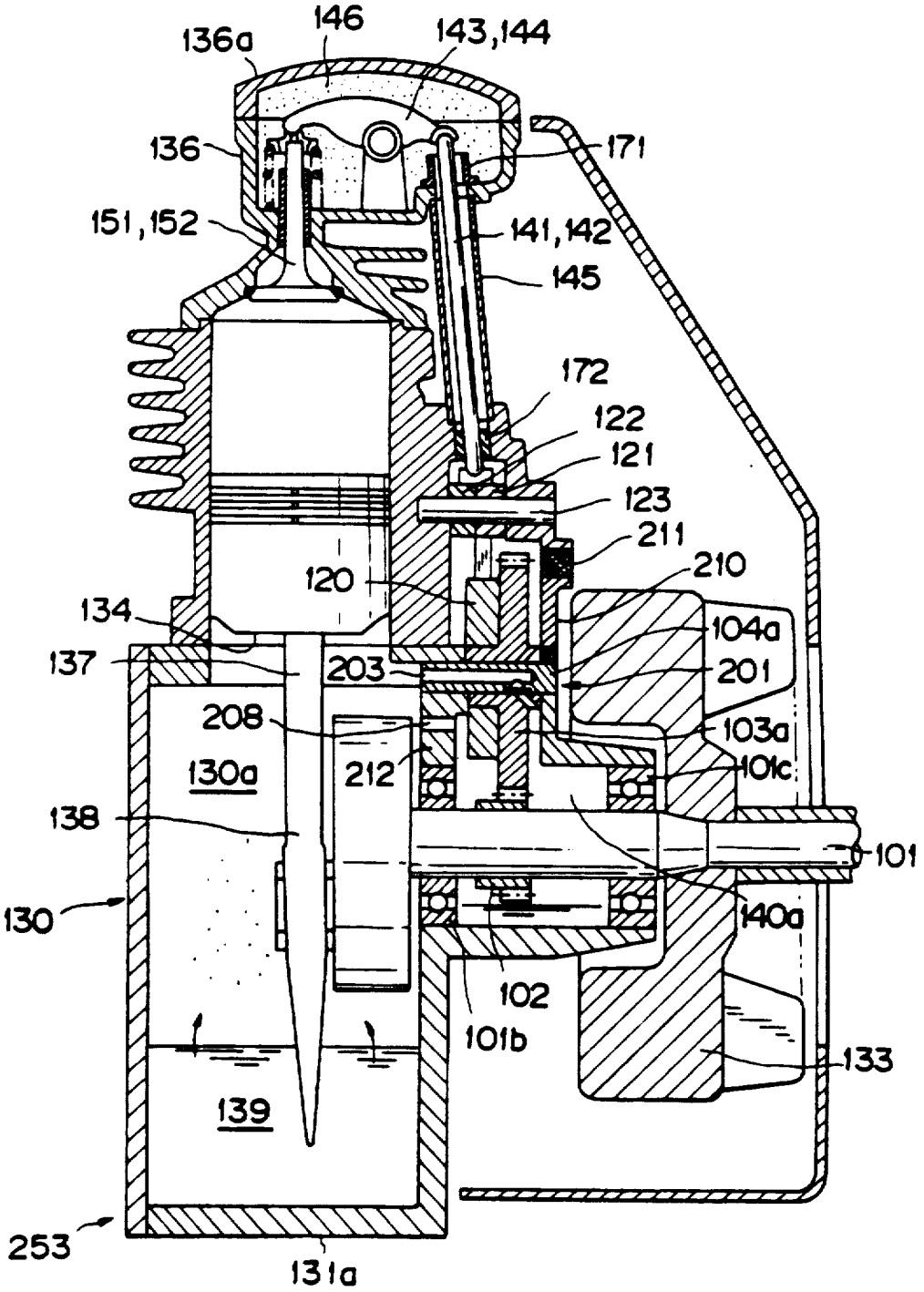
Figure 12:
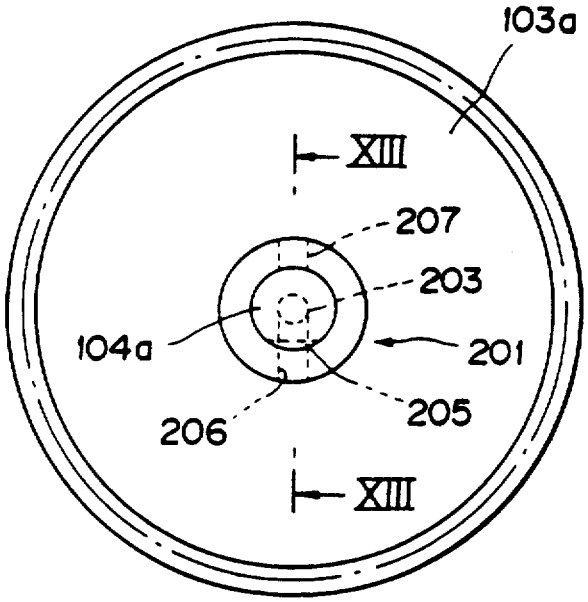
Figure 13:
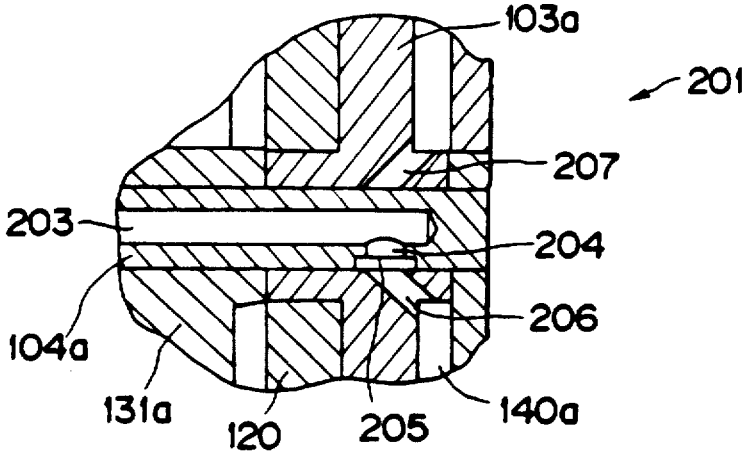
Figure 14:
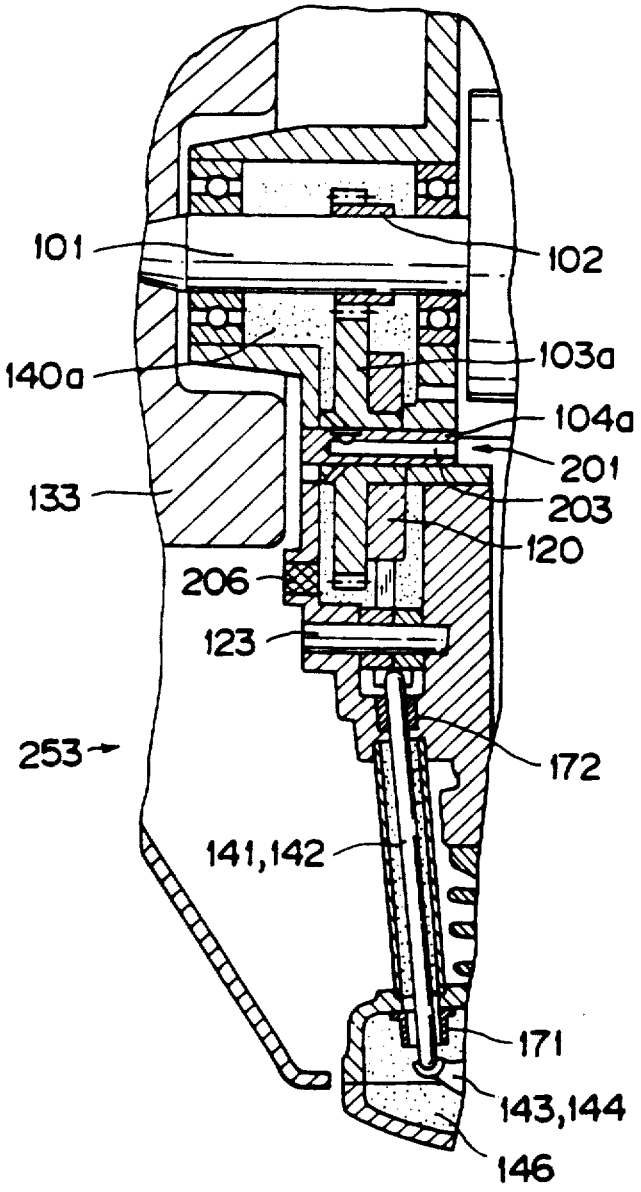

In FIGS. 11 to 13, an engine unit 253 of this second embodiment has basically similar structure of the engine unit 53 shown in FIG. 2, and a breather mechanism 201 is provided to a cam chamber 140a of the engine unit 53 shown in FIG. 2. That is, the breather mechanism 201 comprises a hole 203 which has a closed bottom, is formed in a center of a cam shaft 104a, and is opened, at the opposite side to the closed bottom, to the crank chamber 130a, a hole 204 which is communicated with the hole 203, and extended outwardly in the cam shaft 104a in its radial direction, a recess 205 which is communicated with the hole 204, formed in the cam shaft 104a and opened to a surface of the cam shaft 104a, a breather 211 described hereinafter and other parts. The cam shaft 104a is fixedly supported to a main body 131a and a cam gear 103a is rotatably mounted on the cam shaft 104a. The cam shaft 104a has a longitudinal size so as to reach the crank chamber 130a. A pair of holes 206 and 207 are formed in the cam gear 103a so as to be intermittently communicated with the recess 205 to communicate the hole 203 with a cam chamber 140a. A pair of holes 206 and 207 are positioned, in the cam gear 103a, symmetrically with respect to the center of the hole 203.

Accordingly, when the piston 134 is positioned approximately at a lower dead point and a pressure in the crank chamber 130a is high, the holes 203 and 204, the recess 205 and the hole 206 or 207 are communicated with each other to form a communicating path. Therefore, the lubricating oil 139 in the crank chamber 130a is moved into the cam chamber 140a under the high pressure of the crank chamber 130a. On the other hand, when the piston 134 is positioned at other positions (for example, an upper dead point) except the lower dead point, and the pressure in the crank chamber 130a is low, both of the holes 206 and 207 of the rotating cam gear 103a are not communicated with the recess 205 to close the communicating path, and the lubricating oil 139 cannot pass the communicating path. Therefore, during the rotation of the cam gear 103a, only when the pressure in the crank chamber 130a is high, the holes 206 and 207 are communicated with the crank chamber 130a. The breather mechanism 201 functions as a so-called check valve in this manner. A breathing gas goes from the crank chamber 130a to the cam chamber 140a through the communicating path and then circulates in the cam chamber 140a. Finally, the breathing gas is discharged to an atmosphere through the breather 211 provided in a wall 210 of the cam chamber 140a. Therefore, the lubricating of the cam chamber 140a is improved.

A small hole 208 is formed, in a wall 212 of the main body 131a, which partitions the cam chamber 140a from the crank chamber 130a, so as to communicate the crank chamber 130a with the cam chamber 140a. Through the small hole 208, the lubricating oil 139 of the crank chamber 130a flows into the cam chamber 140a.

As described above, in the engine unit 253 of this embodiment, the grease including molybdenum is sealed in the valve chamber 146, and the liquid lubricating oil 139 is sealed in the crank chamber 130a. The parts of the crank chamber 130a and cam chamber 140a are lubricated by the oil 139.

The functions of the cylindrical part 171 and the seal 172 are similar to the functions of the same of the first embodiment, therefore, the description of the structure of them is neglected.

Accordingly, in the second embodiment of this invention, the lubricating oil 139 can be fed to the cam chamber 140a under the inner pressure of the crank chamber 130a.

Third Embodiment

A third embodiment is described with reference to FIGS. 15 to 17.

This embodiment concerns an improved lubricating manner of the valve chamber of an engine unit.

Figure 15:
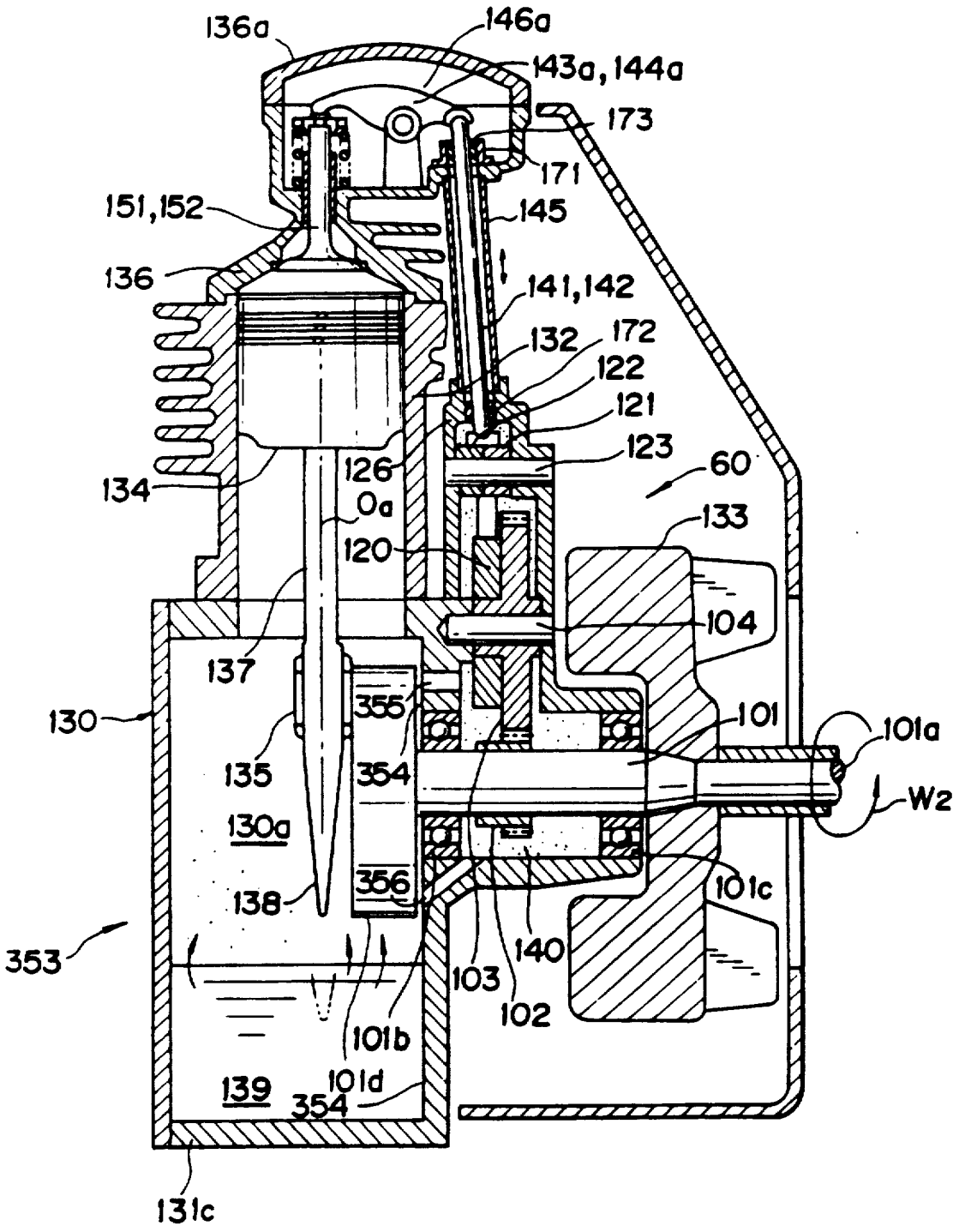
Figure 16:
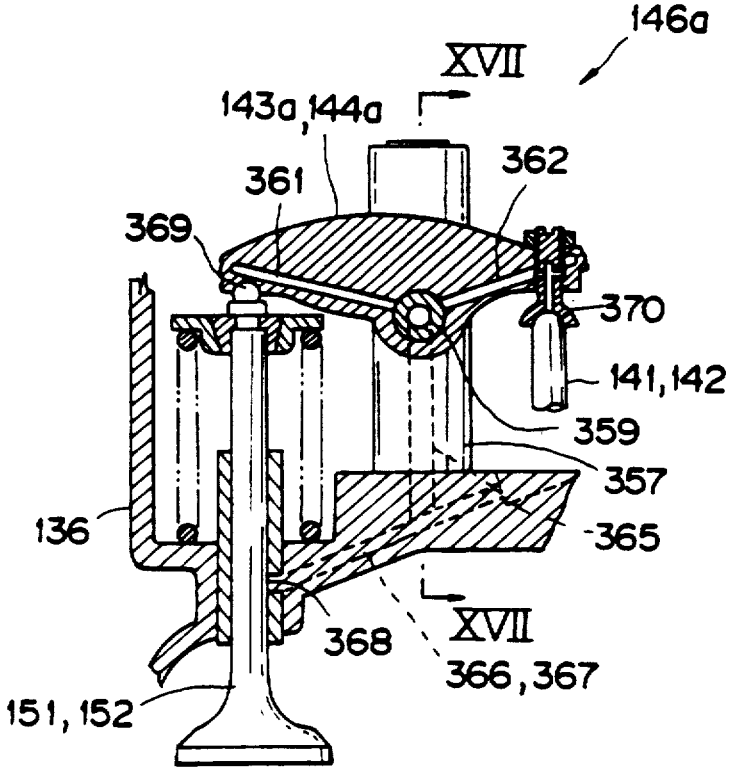

As shown in FIG. 15, the engine unit 353 according to this embodiment has a similar structure of the engine unit 53a shown in FIG. 6. However, the structure in the valve chamber 145 of the engine unit 53a is improved as shown in FIGS. 16 and 17.

As shown in FIG. 15, the crank chamber 130a is lubricated in the same manner as the first embodiment. Through holes 355 and 356 are formed in a wall 354, partitioning the cam chamber 140 from the crank chamber 130a of a main body 131c, and the lubricating oil 139 of the crank chamber 130a flows into the cam chamber 140 through the holes 355 and 356.

A structure of a valve chamber 146a will be described hereunder with reference to FIGS. 16 and 17. In the lubricating mechanism of this embodiment, a holder 357 is mounted on the cylinder head 136 and swingably supports a pair of rocker arms 143a and 144a. A space means for sealing the lubrication oil is formed in the holder 357, the rocker arms 143a and 144a and the cylinder head 136. That is, a path 358 is vertically formed in the holder 357, and a path 360 communicated with the path 358 is horizontally formed in axes 359 and 359 which support the rocker arms 143a and 144a. The path 360 is communicated with two paths 361 and 362 formed in the rocker arm 143a through two holes 363 and 363 formed in the axis 359. The path 360 is communicated with two paths 361 and 362 formed in the other rocker arm 144a through two holes 364 and 364 formed in the axis 359. Sliding portions between the axis 359 and the rocker arms 143a, 144a are lubricated through the holes 363 and 364.

The path 358 is communicated with a path 365 vertically formed in the holder 357 and the cylinder head 136. The path 365 is communicated with a pair of paths 366 and 367 formed in the cylinder head 136 in a downwardly inclined direction, respectively. Each of the paths 366 and 367 is opened to each of sliding portions 368 of the exhaust and intake valves 151 and 152, and each of the sliding portions 368 is lubricated by the oil in the paths 366 and 367.

Each of the paths 361 has a small opening at a contacting portion between each of the upper end portions 369 of the valve shaft of the exhaust and intake valves 151 and 152 and each of the rocker arms 143*a* and 144*a*. Therefore, the contacting portion is lubricated by the oil in each of the paths 361.

On the other hand, each of the paths 362 has a small opening at a contacting portion between each of the upper end portions 370 of the push rods 141 and 142 and each of the rocker arms 143*a* and 144*a*. Therefore, the contacting portion is lubricated by the oil in each of the paths 362.

Figure 17:
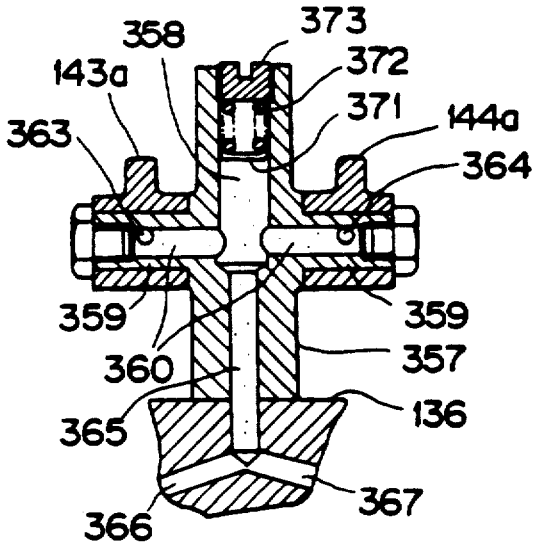

As shown in FIG. 17, in an upper portion of the path 358 is provided a sliding plate 371 which is smoothly slidably inserted in the path 358 and compresses the lubricating oil sealed in a communicated space formed in the rocker arms, the holder and the cylinder head, a spring 372 as elastic means for pushing downwardly the sliding plate 371, and a cap 373 for supporting the spring 372. The cap 373 is screw-inserted in an upper portion in the path 358.

The lubricating oil such as grease including molybenum is sealed in the path 358, 360 to 362 and 365 to 367. The lubrication oil of the space is always compressed by a spring force of the spring 372 through the slide plate 371 with a constant pressure. Therefore, the lubricating oil is continuously fed to each of the contacting portions. Therefore, it is not necessary to supplement the new oil in the space.

As described above, in the lubricating device in the third embodiment of this invention, the valve chamber 146*a* is independently lubricated by the oil of the space without using the lubricating oil 139 of the crank chamber 130*a*. Accordingly, the efficiency of lubrication is increased in comparison with the traditional device, and the life of the lubricating oil 139 becomes long. Further, since there is no oil in the head cover 136*a*, it is not necessary to provide on the head cover 136*a* the breather for discharging an oil mist from the valve chamber 146*a*.

In all of figures, like reference numerals show members and elements corresponding to those shown in the first embodiment.

What is claimed is:

1. A lubricating device of a four-stroke cycle engine unit for a portable working machine, said lubricating device comprising:

a holder for pivotably supporting a pair of rocker arms which operatively connect ends of a pair of push rods to an intake and exhaust valve, said holder having a space formed therein for receiving a quantity of lubrication oil and a series of pathways connecting said space to contacting portions of rocker arms, valves and push rods; and spring means mounted on the holder for maintaining oil within the holder space in a compressed state thereby supplying lubricating oil to the rocker arms, push rods and valves during engine operation.

2. A lubricating device of a four-stroke cycle engine unit according to claim 1, wherein the lubricating oil is grease.

3. A lubricating device of a four-stroke cycle engine unit according to claim 1, wherein said spring means comprises:

a sliding plate smoothly slidably inserted in the space, a spring biasing the plate inwardly, and a screwed cap supporting the spring.

4. A lubricating device of a four-stroke cycle engine unit according to claim 11, wherein said space comprises:

a path vertically formed in the holder;

a path horizontally formed in axes supporting the rocker arms, respectively, and communicated with a vertical path;

paths formed in each of the rocker arms and communicated with the horizontal path through holes formed in each of the axes, wherein the rocker arms are lubricated through holes, and end portions of exhaust and intake valves and upper ends of the push rods are lubricated through the holes; and a pair of paths connecting said space to each of the sliding portions of the exhaust and intake valves, respectively.

5. A lubricating device of a four-stroke cycle engine unit according to claim 4, wherein the lubricating oil in the space means is molybdenum grease.

6. A lubricating device of a four-stroke cycle engine unit according to claim 1, wherein the lubricating oil is independent of any lubricant used in the engine's crankcase.

* * * * *

UNITED STATES PATENT AND TRADEMARK OFFICE

CERTIFICATE OF CORRECTION

PATENT NO. : 5,213,074

DATED : May 25, 1993

INVENTOR(S) : Youichi Imagawa et al.

It is certified that error appears in the above-identified patent and that said Letters Patent is hereby corrected as shown below:

Column 10, Line 26, after "claim" replace "11" with --1--.

Signed and Sealed this

Sixteenth Day of May, 1995

Bruce Lehman

*Attest:*

BRUCE LEHMAN

*Attesting Officer*

*Commissioner of Patents and Trademarks*